US008016297B2

(12) United States Patent
Heinemann et al.

(10) Patent No.: US 8,016,297 B2
(45) Date of Patent: Sep. 13, 2011

(54) GAS TURBINE ENGINE SEALS AND ENGINES INCORPORATING SUCH SEALS

(75) Inventors: Kurt R. Heinemann, North Berwick, ME (US); Jose Paulino, West Palm Beach, FL (US); Scot A. Webb, Gales Ferry, CT (US); Mark Ring, Cape Neddick, ME (US); Charles H. Warner, S. Portland, ME (US)

(73) Assignee: United Technologies Corporation, Hartford, CT (US)

( * ) Notice: Subject to any disclaimer, the term of this patent is extended or adjusted under 35 U.S.C. 154(b) by 654 days.

(21) Appl. No.: 12/056,792

(22) Filed: Mar. 27, 2008

(65) Prior Publication Data

US 2009/0243228 A1 Oct. 1, 2009

(51) Int. Cl.
*F16J 15/02* (2006.01)

(52) U.S. Cl. ..... 277/644; 277/645; 277/647

(58) Field of Classification Search ..... 277/647, 277/530, 644, 645

See application file for complete search history.

(56) References Cited

U.S. PATENT DOCUMENTS

| | | | | | |
|---|---|---|---|---|---|
| 3,012,802 | A * | 12/1961 | Waite | 277/608 |
| 3,575,432 | A * | 4/1971 | Taylor | 285/367 |
| 3,879,043 | A * | 4/1975 | Tozer | 277/647 |
| 4,199,151 | A * | 4/1980 | Bartos | 277/306 |
| 4,573,866 | A * | 3/1986 | Sandy et al. | 415/116 |
| 4,589,666 | A * | 5/1986 | Halling | 277/631 |
| 4,779,901 | A * | 10/1988 | Halling | 285/184 |
| 4,854,600 | A * | 8/1989 | Halling et al. | 277/626 |
| 5,092,735 | A * | 3/1992 | Katy et al. | 415/115 |
| 5,188,506 | A | 2/1993 | Creevy et al. | |
| 5,240,263 | A * | 8/1993 | Nicholson | 277/614 |
| 5,249,814 | A * | 10/1993 | Halling | 277/654 |
| 5,630,593 | A * | 5/1997 | Swensen et al. | 277/626 |
| 5,924,699 | A | 7/1999 | Airey et al. | |
| 6,120,037 | A * | 9/2000 | Schmertz | 277/647 |
| 6,199,871 | B1 * | 3/2001 | Lampes | 277/614 |
| 6,299,178 | B1 * | 10/2001 | Halling | 277/654 |
| 6,315,298 | B1 | 11/2001 | Kildea et al. | |
| 6,446,978 | B1 * | 9/2002 | Halling et al. | 277/626 |
| 6,450,762 | B1 | 9/2002 | Munshi | |
| 6,588,761 | B2 * | 7/2003 | Halling | 277/312 |
| 6,637,751 | B2 | 10/2003 | Aksit et al. | |
| 6,648,333 | B2 | 11/2003 | Askit et al. | |
| 6,769,698 | B2 * | 8/2004 | Kamiya et al. | 277/614 |
| 7,032,905 | B2 * | 4/2006 | Mullally | 277/647 |
| 7,090,459 | B2 | 8/2006 | Bhate et al. | |
| 7,152,864 | B2 | 12/2006 | Amos et al. | |
| 7,172,388 | B2 | 2/2007 | Synnott | |
| 7,195,246 | B2 * | 3/2007 | Aoshiba et al. | 277/438 |
| 7,201,381 | B2 * | 4/2007 | Halling | 277/604 |
| 7,201,558 | B2 | 4/2007 | Norris et al. | |

* cited by examiner

*Primary Examiner* — Alison Pickard
(74) *Attorney, Agent, or Firm* — Kinney & Lange, P.A.

(57) ABSTRACT

Gas turbine engine seals and engines incorporating such seals are provided. In this regard, a representative seal includes: an annular seal body having an inner diameter and an outer diameter, the seal body extending along an axis of symmetry between a first end and a second end; the seal body being formed of a strip of material having first and second opposing edges, the strip of material being deformed to exhibit a first sealing surface at the first end, a second sealing surface at the second end, and a third sealing surface along the inner diameter, the first edge being located adjacent to the third sealing surface, the second edge being located adjacent to the second sealing surface; the first edge being spaced from the second edge to define an annular opening, the annular opening providing access to an annular cavity of the seal body.

13 Claims, 2 Drawing Sheets

GAS TURBINE ENGINE SEALS AND ENGINES INCORPORATING SUCH SEALS

BACKGROUND

1. Technical Field

The disclosure generally relates to gas turbine engines.

2. Description of the Related Art

Various types of seals are used at various locations and for various purposes throughout a gas turbine engine. By way of example, some seals are used to separate different fluids, while others are used to separate regions of disparate fluid pressure. Regardless of the particular configuration, a typical concern in choosing a seal for a particular application is sealing efficiency, i.e., the degree to which the seal accomplishes the intended purpose. Oftentimes, improvements in sealing efficiency can lead to improvements in gas turbine engine performance, such as by improving fuel economy.

SUMMARY

Gas turbine engine seals and engines incorporating such seals are provided. In this regard, an exemplary embodiment of a gas turbine engine seal comprises: an annular seal body having an inner diameter and an outer diameter, the seal body extending along an axis of symmetry between a first end and a second end; the seal body being formed of a strip of material having first and second opposing edges, the strip of material being deformed to exhibit a first sealing surface at the first end, a second sealing surface at the second end, and a third sealing surface along the inner diameter, the first edge being located adjacent to the third sealing surface, the second edge being located adjacent to the second sealing surface; the first edge being spaced from the second edge to define an annular opening, the annular opening providing access to an annular cavity of the seal body.

An exemplary embodiment of a gas turbine engine seal comprises: a first gas turbine engine component; a second gas turbine engine component; and an annular seal body forming a seal between the first component and the second component, the seal body extending between a first axial end and a second axial end, the seal body exhibiting a first sealing surface at the first end, a second sealing surface at the second end, and a third sealing surface, the seal body having an annular opening providing access to an annular cavity of the seal body; the first gas turbine engine component, the second gas turbine engine component and the seal body defining a higher pressure side and a lower pressure side, the annular opening being positioned adjacent to the higher pressure side.

An exemplary embodiment of a gas turbine engine comprises: a radially inner, high pressure region; a radially outer, lower pressure region; and an annular seal positioned between the high pressure region and the lower pressure region, the seal having opposing axial sealing surfaces and an inner diameter sealing surface, the seal defining an annular cavity operative to communicate with the high pressure region such that pressure within the cavity tends to urge the axial sealing surfaces and the inner diameter sealing surface into contact with corresponding engagement surfaces of the gas turbine engine.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engine seals and engines incorporating such seals are provided, several exemplary embodiments of which will be described in detail. In some embodiments, an annular seal is positioned between a high pressure region and a lower pressure region of a gas turbine engine, with the seal including opposing axial sealing surfaces and an inner diameter sealing surface. These three annular-shaped sealing surfaces are urged into sealing engagement by gas pressure that fills an annular cavity of the seal.

Figure 1:
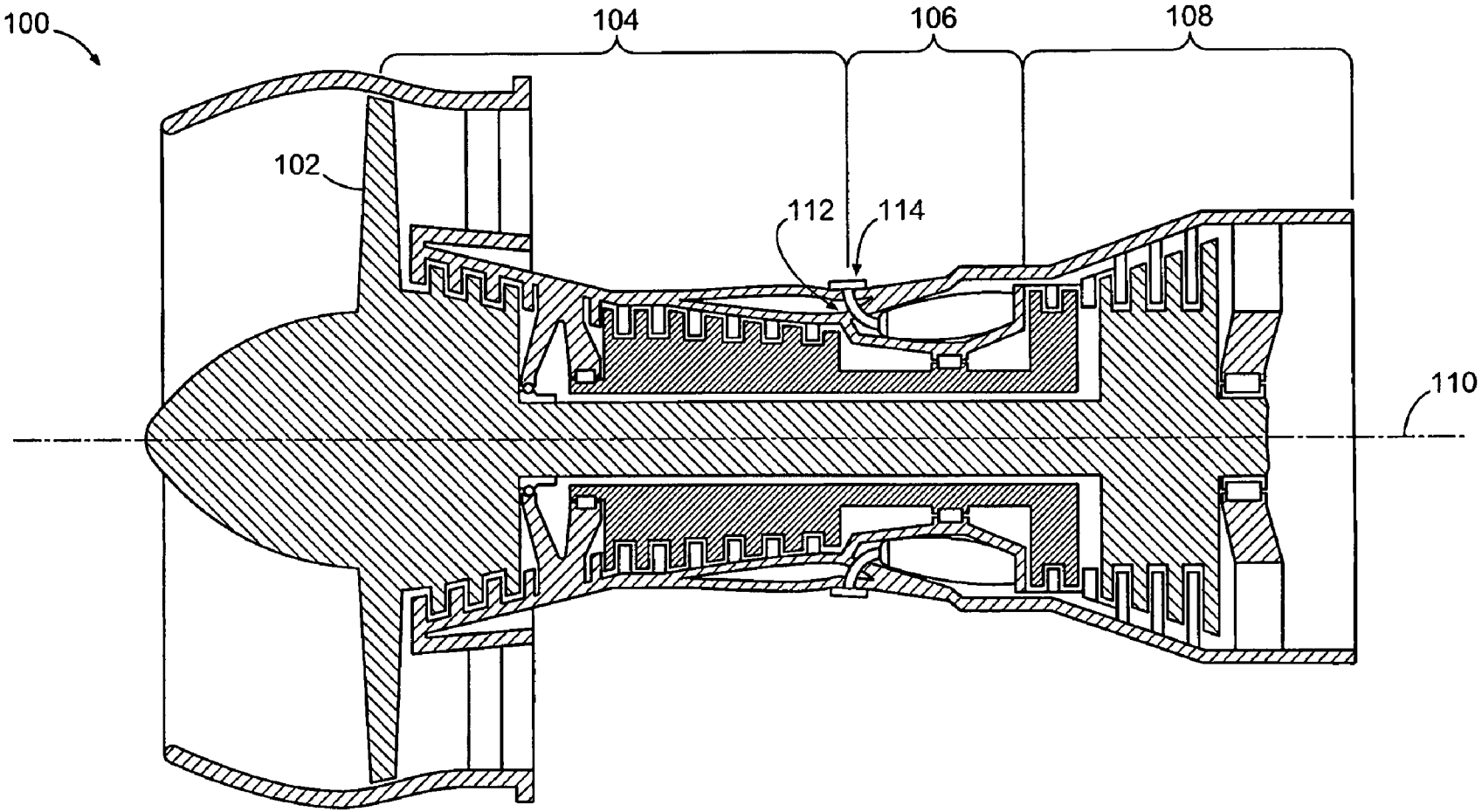
FIG. 1 is a schematic diagram depicting an exemplary embodiment of a gas turbine engine.

In this regard, reference is made to the schematic diagram of FIG. 1, which depicts an exemplary embodiment of a gas turbine engine. As shown in FIG. 1, engine 100 is a turbofan that incorporates a fan 102, a compressor section 104, a combustion section 106 and a turbine section 108 that extend along a common axis 110. Although depicted as a turbofan gas turbine engine, it should be understood that the concepts described herein are not limited to use with turbofans, as the teachings may be applied to other types of gas turbine engines.

Engine 100 also includes an exit guide vane assembly 112 that is positioned upstream of a diffuser case 114 of the combustion section. As will be described in more detail with respect to FIG. 2, an annular seal element is positioned between the exit guide vane assembly 112 and the diffuser case 114.

Figure 2:
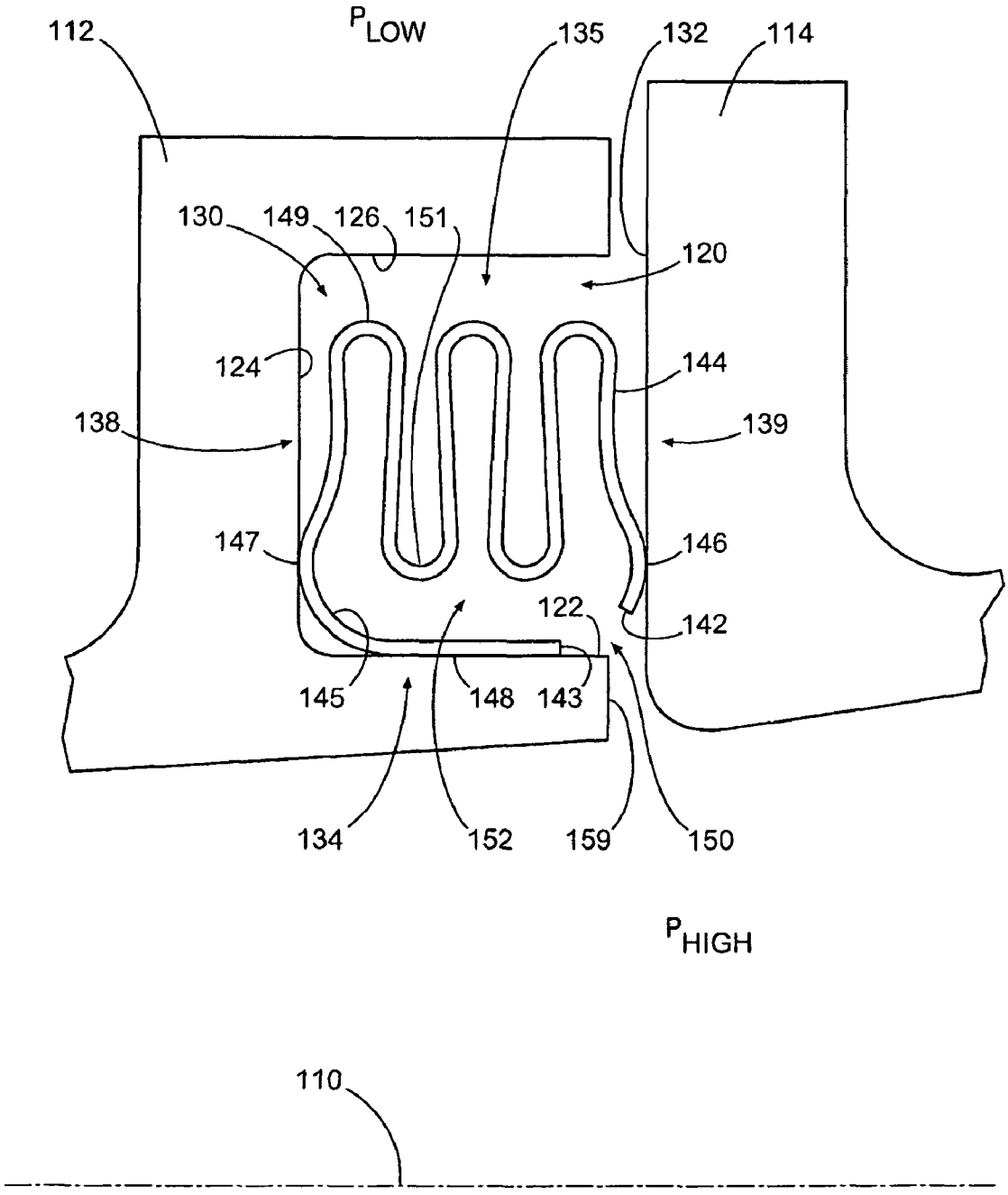
FIG. 2 is a schematic diagram depicting a portion of the engine of FIG. 1, showing an exemplary embodiment of a seal.

In FIG. 2, exit guide vane assembly 112 incorporates a channel 120 that is defined by an inner diameter surface 122, a radial surface 124 and an outer diameter surface 126. Seal body 130 is positioned within channel 120 and forms a seal between assembly 112 and diffuser case 114. Specifically, seal body forms a seal between surfaces 122 and 124 of assembly 112 and radial surface 132 of diffuser case 114.

Seal body 130 is annular in shape and extends between an inner diameter 134 and an outer diameter 135. The seal body also extends along an axis of symmetry (e.g., axis 110) between a first end 138 (e.g., an upstream end) and a second end 139 (e.g., a downstream end). In this embodiment, the seal body is formed of a continuous strip of material that includes opposing edges 142, 143, with opposing sides 144, 145 extending between the edges. The strip of material, which may be metal (such as a nickel based superalloy, Inconel X-750 or Inconel 718, for example) is deformed to exhibit axial sealing surfaces 146, 147 and an inner diameter sealing surface 148.

From edge 142, the seal body curves to form sealing surface 146, which is convex and which forms an axially outermost portion of the seal body at end 139. Following the sealing surface 146 is a series of corrugations including alternating ridges (e.g., ridge 149) and troughs (e.g., trough 151). In this embodiment, the ridges and the troughs are curved, although other configurations can be used in other embodiments. Additionally, although two full corrugations are depicted in this embodiment, various other numbers can be used.

Continuing about the periphery of the seal body, sealing surface 147 (which also is convex in shape) forms an axially outermost portion of the seal body at end 138. From sealing surface 147, the seal body exhibits a continuous curve that leads to sealing surface 148. In this embodiment, sealing surface 148 is straight as viewed in cross-section, and terminates at edge 143. Notably, edge 143 is spaced from edge 142 to define an opening 150, with the edge 142 being axially displaced from an axial location of edge 143 when the seal body is in a relaxed (i.e., unbiased) state. Opening 150 provides access to an annular cavity 152 that is formed by side 145 of the seal body.

Sealing surface 148 can be provided in various lengths, with the terminating edge 143 being located at various distances from edge 159. Notably, edge 159 can be configured to provide adequate clearance for opening 150.

In operation, relatively high pressure from region $P_{HIGH}$ occupies cavity 152, whereas relatively lower pressure from region $P_{LOW}$ occupies the volume outside of surface 144 of the seal body. The higher pressure urges the sealing surfaces of the seal body into contact with the corresponding surfaces of assembly 112 and case 114. In particular, sealing surface 146 is urged against surface 132, sealing surface 147 is urged against surface 124 and sealing surface 148 is urged against surface 122. Notably, in the embodiment of FIG. 2, sealing surface 148 exhibits a slightly smaller diameter than surface 122 exhibits when the seal body is in the relaxed state. Thus, during installation, seal body 130 is urged into position by deflecting surface 148 radially outwardly so that the seal body can fit about surface 122. As such, a snug frictional fit between surface 122 and sealing surface 148 can be present before the cavity of the seal is pressurized.

In contrast to the embodiment of FIG. 2, which is formed of a continuous sheet of material, other embodiments can be formed in other manners, such as by circumferentially joining multiple pieces by welding or brazing, for example, so that the sealing element is continuous and smooth in the circumferential direction. Additionally or alternatively, some embodiments can be formed with overlapping joints.

Notably, in the embodiment of FIG. 2, the opening is located on the radially inboard and downstream portions of the sealing element. However, openings can be formed in other locations in other embodiments. Orientation of the opening can be selected base on various factors, one of which being locating the opening adjacent to the higher pressure side of the seal in order to promote proper sealing.

A conventional installed W or E seal typically includes two sealing interfaces (e.g., as described above with respect to surface 146 against surface 132). In such a seal, the leakage across the sealing interfaces typically is the same at both locations, due to comparable surface geometry, pressure differential and working fluid. By replacing one of these sealing interfaces with a radial interference fit (such as described above with respect to surface 148 against surface 122, the leakage across the sealing interface with the radial interference fit should be relatively small compared to the other sealing interface. For instance, the leakage of surface 148 against surface 122 should be negligible compared to the leakage across the other sealing interface. Hence, in some embodiments, the seal should exhibit approximately one half of the leakage as a comparable conventional E or W seal.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A gas turbine engine sealing element comprising:

an annular seal body having an inner diameter and an outer diameter, the seal body extending along an axis of symmetry between a first end and a second end;

the seal body being formed of a strip of material having first and second opposing edges, the strip of material being deformed to exhibit a first sealing surface at the first end, a second sealing surface at the second end, the seal body exhibits at least two corrugations, each corrugation having a ridge and a trough between the first end and the second end, and a third sealing surface along the inner diameter, the third sealing surface located radially inward from and axially between the first sealing surface and the second sealing surface so as to be biased radially inward, the first edge being located adjacent to the third sealing surface, the second edge being located adjacent to the second sealing surface;

wherein the first edge is spaced from the second edge to define an annular opening, the annular opening providing access to an annular cavity of the seal body, the seal body exhibits a continuous curve between the second sealing surface and the third sealing surface and the third sealing surface comprises a straight portion of the seal body.

2. The sealing element of claim 1, wherein the corrugations are operative to bias the seal body responsive to an axial deflection of the seal body.

3. The sealing element of claim 1, wherein the second edge is curved toward the annular cavity.

4. The sealing element of claim 1, wherein the first sealing surface and the second sealing surface are the axial outermost portions of the seal body.

5. The sealing element of claim 1, wherein:

the strip of material forming the seal body has a first surface and an opposing second surface, the first surface and the second surface extending between the first and second edges;

the annular cavity is defined by the first surface; and the first sealing surface, the second sealing surface and the third sealing surface are defined by the second surface.

6. A gas turbine engine seal comprising:

a first gas turbine engine component;

a second gas turbine engine component; and an annular seal body forming a seal between the first component and the second component, the seal body being formed of a strip of material having first and second opposing edges, the seal body extending between a first axial end and a second axial end, the seal body exhibiting a first sealing surface at the first end, a second sealing surface at the second end, the seal body exhibits at least two corrugations, each corrugation having a ridge and a trough between the first end and the second end, and a third sealing surface contacting the first gas turbine engine component along an inner diameter surface thereof, the third sealing surface located radially inward from and axially between the first sealing surface and the second sealing surface so as to be biased radially inward, the first edge located adjacent to the third sealing surface, the second edge being located adjacent to the second sealing surface and the first edge is spaced from the second edge to define an annular opening the annular opening providing access to an annular cavity of the seal body from a high pressure region radially inward of the seal body;

wherein the first gas turbine engine component, the second gas turbine engine component and the seal body defining a higher pressure side and a lower pressure side, the annular opening being positioned adjacent to the higher pressure side and wherein the third sealing surface comprises a straight portion of the seal body, the seal body exhibits a continuous curve between the second sealing surface and the third sealing surface, and the third sealing surface engages the inner diameter surface of the first gas turbine engine component in a radial interference fit.

7. The seal of claim 6, wherein the second sealing surface and the third sealing surface of the seal body contact the first gas turbine engine component.

8. The seal of claim 7, wherein:

the third sealing surface is annular and exhibits, in an unbiased state, a diameter that is smaller than the diameter of the annular inner diameter surface of the first gas turbine engine component such that engagement of the third sealing surface about the annular inner diameter surface forms a frictional fit.

9. The seal of claim 6, wherein:

the strip of material forming the seal body has a first surface and an opposing second surface, the first surface and the second surface extending between the first and second edges;

the annular cavity is defined by the first surface; and the first sealing surface, the second sealing surface and the third sealing surface are defined by the second surface.

10. A gas turbine engine comprising:

a first gas turbine engine component;

a second gas turbine engine component;

a radially inner, high pressure region;

a radially outer, lower pressure region; and an annular seal positioned between the high pressure region and the lower pressure region, the seal body being formed of a strip of material having first and second opposing edges and extending between a first axial end and a second axial end, the annular seal has a first sealing surface contacting the second gas turbine engine component at the first end, a second sealing surface contacting the first gas turbine engine component at the second end, the seal exhibits at least two corrugations, each corrugation having a ridge and a trough between the first sealing surface and the second sealing surface, and a third sealing surface contacting an inner diameter surface of the first gas turbine engine component in a radial interference fit along an inner diameter surface thereof, the third sealing surface located radially inward from and axially between the first sealing surface and the second sealing surface so as to be biased radially inward, the first edge located adjacent to the third sealing surface, the second edge being located adjacent to the second sealing surface and the first edge is spaced from the second edge to define an annular opening to an annular cavity that communicates with the high pressure region such that pressure within the cavity tends to urge the first, second, and third sealing surfaces into contact with the first and second engine components of the gas turbine engine, and wherein the annular opening provides access to the cavity, the seal exhibits a continuous curve between the second sealing surface and the third sealing surface and the third sealing surface comprises a straight portion of the seal.

11. The engine of claim 10, wherein the high pressure region and the low pressure region are located upstream of a turbine section of the engine.

12. The engine of claim 10, wherein:

the engine has an exit guide vane assembly and a diffuser case; and the annual seal forms a seal between the exit guide vane assembly and the diffuser case.

13. The engine of claim 10, wherein the engine is a turbofan gas turbine engine.

* * * * *